US005175898A

United States Patent [19]

Johenning et al.

[11] Patent Number: 5,175,898

[45] Date of Patent: * Jan. 5, 1993

[54] SCULPTURED, STRETCHABLE WATERBED MATTRESS WITH AESTHETIC APPEARANCE

[75] Inventors: John B. Johenning, Los Angeles; Charles P. Hall, Santa Rosa, both of Calif.

[73] Assignee: Advanced Sleep Products, Carson, Calif.

[ * ] Notice: The portion of the term of this patent subsequent to Apr. 22, 2003 has been disclaimed.

[21] Appl. No.: 810,081

[22] Filed: Dec. 17, 1985

Related U.S. Application Data

[63] Continuation-in-part of Ser. No. 591,013, Mar. 19, 1984, Pat. No. 4,583,254.

[51] Int. Cl.[5] ..... A47C 27/08

[52] U.S. Cl. ..... 5/451; 5/450

[58] Field of Search ..... 5/451, 450, 449, 441, 5/452, 455, 482

[56] References Cited

U.S. PATENT DOCUMENTS

| | | | |
|---|---|---|---|
| D. 187,638 | 4/1960 | Kelley | D5/5 |
| D. 260,951 | 9/1981 | Paripovich et al. | D6/1 |
| 379,827 | 3/1888 | Snavely et al. | 5/458 |
| 489,517 | 1/1893 | Woods | 5/451 |
| 773,828 | 11/1904 | Titus | 5/451 |
| 1,212,479 | 1/1917 | Hall | 5/451 |
| 1,582,842 | 4/1926 | Lorenz . | |
| 1,594,382 | 8/1926 | Rock . | |
| 1,943,888 | 1/1934 | Ewald . | |
| 1,948,138 | 2/1934 | Sindler . | |
| 2,565,491 | 8/1951 | Francis, Jr. . | |
| 3,108,293 | 10/1961 | King . | |
| 3,428,973 | 2/1969 | Hargest et al. | 5/449 |
| 3,456,270 | 7/1969 | Weinstein et al. | 5/451 |
| 3,497,059 | 2/1970 | Watts | 5/451 |
| 3,585,356 | 6/1971 | Hall | 219/217 |
| 3,600,726 | 8/1971 | Williams | 5/451 |
| 3,689,949 | 9/1972 | Weinstein et al. | 5/451 |
| 3,707,735 | 1/1973 | Carson | 5/451 |
| 3,803,647 | 4/1974 | Reswick | 5/451 |
| 3,810,265 | 5/1974 | McGrew | 5/451 |
| 3,842,455 | 10/1974 | Whitney | 5/451 |
| 3,849,814 | 11/1974 | Ross | 5/451 |
| 4,107,799 | 8/1978 | Lambert | 5/451 |
| 4,192,031 | 3/1980 | Fogel | 5/451 |
| 4,292,702 | 7/1979 | Phillips | 5/451 |
| 4,301,560 | 11/1981 | Fraige | 5/450 |
| 4,332,043 | 1/1980 | Larson | 5/460 |
| 4,345,348 | 8/1982 | Hall | 5/450 |
| 4,365,370 | 4/1980 | Larson | 5/451 |
| 4,422,194 | 12/1983 | Viesturs et al. | 5/455 |
| 4,662,012 | 5/1987 | Torbet | 5/453 |

FOREIGN PATENT DOCUMENTS

| | | |
|---|---|---|
| 0023148 | 1/1981 | European Pat. Off. . |
| 0116470 | 8/1984 | European Pat. Off. . |
| 0183012 | 6/1986 | European Pat. Off. . |
| 0190113 | 8/1986 | European Pat. Off. . |
| 550650 | 5/1932 | Fed. Rep. of Germany . |
| 8403027 | 8/1984 | PCT Int'l Appl. . |
| 2801 | of 1878 | United Kingdom . |
| 932779 | 5/1962 | United Kingdom . |

OTHER PUBLICATIONS

Jobst Hydro-Float Bed, Instructions for Operation, Jobst Institute, Inc., 1970 Box 653, Toledo, Ohio, 43601.

Jobst Hydro-Float Waterbed, Instructions for Installation and Use, Jobst Institute, Inc., Box 653, Toledo, Ohio 43601.

(List continued on next page.)

*Primary Examiner*—Alexander Grosz

*Attorney, Agent, or Firm*—Kinzer, Plyer, Dorn, McEachran & Jambor

[57] ABSTRACT

A low tension waterbed mattress has a top with a plurality of expandable folds molded therein so that the top wall stretches when a user lays on the mattress so that the user is not laying on a taut sleeping surface. The folds have an aesthetic appearance. The mattress is typically filled to a volume providing a depth at least 3 inches less than the capacity of the mattress. The top wall of the mattress when pulled taut has a surface area at least 3% larger than the surface area of the bottom wall of the mattess.

35 Claims, 4 Drawing Sheets

OTHER PUBLICATIONS

Product News, Hydro-Float Waterbed, Jobst Institute, Copyright 1970 Box 653, Toledo, Ohio 43601.

Product News, Hydro-Float Bed, Jobst Institute, Copyright 1969 Box 653, Toledo, Ohio, 43601.

Advertisement by Kuss Corporation published in *Industry* magazine, Sep., 1978 issue.

Waterbed Designs Information Sheet, publishing date unknown, (Louisville, Ky. ).

*Modern Plastics Encyclopedia*, Oct., 1986 vol. 63, No. 10A (McGraw Hill, New York).

Advertisment by Calco-Hawaiian, Inc. published in *Industry* magazine, Jul. 1976.

One-page unpublished document purportedly prepared in 1977 by Easyrest, Inc. (Jeffersonville, Ind.).

Advertisement by Land & Sky of Lincoln, Neb.(undated).

Advertisement of Easyrest, Inc. (Jeffersonville, Ind.) undated.

Article by Richard J. Allan published in Sep., 1986 issue of *Flotation Sleep Industry magazine.*

Advertisement by Classic Products Corp. (Los Angeles, Calif.), published in May 25, 1975 issue of *Industry* magazine.

Advertisement by Classic Products Corp. (Los Angeles, Calif.), published in *Industry* magazine, Jan./Feb. 25, 1976.

Advertisement of Land & Sky (Lincoln, Neb.) published in *Industry* magazine, Feb., 1977 issue.

Advertisement by Wavecrest (Los Angeles, Calif.) published in *Industry* magazine, Feb., 1977 issue.

Advertisement by R. L. Kuff & Co., Inc. (Findlay, Ohio) published in *Industry* magazine, Feb., 1977 issue.

Advertisement by American-National Watermattress Corp. published in *Industry* magazine, Feb., 1977 issue.

Page 37 from an article published in *Industry* magazine, Feb., 1977 issue.

Advertisement by Easyrest, Inc. (Jeffersonville, Ind.) published in *Industry* magazine, Nov. 1977 issue.

Advertisement by Mollura Industries (Industry, Calif.) published in *Industry* magazine, Sep., 1978 issue.

Advertisement by Kuss Corporation (Findlay, Ohio) published in *Industry* magazine, Sep., 1978 issue.

Article entitled "Don't Spent It Before You Get It", published in *Retailing Today* magazine, Jan., 1979 issue.

Advertisement by Kuss Corporation (Findlay, Ohio) published in *Retailing Today* magazine, Jan., 1979 issue.

Advertisement by Land & Sky (Lincoln, Neb.) published in *Industry* magazine, Jan., 1986 issue.

Undated document written for Land & Sky (Lincoln, Neb.).

Advertisement by Land & Sky (Lincoln, Neb.) purportedly published in *Industry* magazine, Feb., 1977.

Advertisement by Easyrest, Inc. (Jeffersonville, Ind.). Defendants in the litigation of the parent patent contend that this document was published in 1977.

Advertisement and price list for Easyrest, Inc. (Jeffersonville, Ind.). The price list purports to be effective Sep. 1980.

Undated advertisement by waterbed designs.

Advertisement and price list for Classic Products Corp. The price lists purports to be effective Feb., 1977.

Advertisement and price list for Wavecrest (Los Angeles, Calif.). The price list purports to be effective May 1, 1978.

Advertisement by Wavecrest (Los Angeles, Calif.) Defendants in the litigation involving the parent application contend that this advertisement was published in 1975.

Advertisement and price list for American National Watermattress Corporation (Orange, Calif). The price list purports to be effective Feb. 1, 1979.

SCULPTURED, STRETCHABLE WATERBED MATTRESS WITH AESTHETIC APPEARANCE

CROSS-REFERENCE

This application is a continuation-in-in-part of U.S. patent application Ser. No. 591,013 filed Mar. 19, 1984, now U.S. Pat. No. 4,583,254, which is incorporated herein by reference.

BACKGROUND

The present invention relates to waterbed mattresses.

A problem with conventional waterbed mattresses is that the user does not really sleep on water. Rather, the user sleeps on polymeric material. Water Waterbed mattress typically are made of an envelope having a top wall, a bottom wall, and side walls formed of a polymeric material such as polyvinylchloride. Other polymeric materials that have been suggested include polyethylene.

Mattresses are generally filled with water to about their design capacity, the depth of the water being from 8 to 9 inches. The amount of water placed in the mattress controls the "firmness" of the mattress.

When a person lays on the mattress, the top wall becomes taut and has high tension. Although the user believes he is sleeping on water., the dominant effect is produced by the taut top wall of the mattress. Although such a waterbed is more comfortable for many persons than a conventional box spring and mattress, the user is really not "floating" water. It is believed that the lack of comfort resulting from the taut top wall has prevented some persons from using a waterbed.

Another problem with available waterbed designs is that the mattress itself has limited aesthetic appeal in the showroom. It is usually no more than flat, stretched piece of vinyl material which may have wrinkles on its top surface. This is in sharp contrast to the aesthetically pleasing and textured surface provided by the fabric on conventional mattresses. Since waterbed mattresses and conventional mattresses are often sold side-by-side in retail outlets, this is a significant competitive disadvantage for waterbed mattresses.

Another problem with available waterbed designs is how to accommodate couples of greatly different weights. When two persons of greatly different weight are on a waterbed mattress, often the heavier person forces so much of the water to the other side of the mattress that the lighter person is laying on a bulge. Another problem occurs where the persons sharing a waterbed mattress desire different firmness from the sleeping surface. To accommodate couples of different weight or couples desiring different firmnesses, there are available small size mattresses that can be placed in a single frame side-by-side. However, these side-by-side mattresses are more expensive than a single mattress, inconvenient to install, and invariable have a all a between them.

SUMMARY

The present invention is directed to a waterbed mattress that overcomes these problems. The mattress has a polymeric top wall providing a sleeping surface, a bottom wall, and side walls. The top wall has a length and a width and a plurality of expandable folds formed therein so that the top wall stretches when a user lays on the mattress. The ratio of the surface area of the top wall when pulled taut to the surface area of the top wall when pulled taut is at least 1.03, and generally is less than 1.3, and preferably is less than 1.2. Similarly, the ratio of the surface area of the top wall when pulled taut to the surface are of a conventional bottom wall when pulled taut is at least 1.03, and is generally less than 1.3, and is preferably less than 1.2, i.e. preferably only the top wall has the extra material. Preferably the folds are in a regular and uniform repeating pattern for aesthetic appeal.

To achieve the desired amount of stretching, preferably the folds are spaced apart from each other by a distance (L), of from about $\frac{1}{4}$ to about 4 inches, more preferably from about 1 to about 3 inches, and most preferably by about 2 inches. The ratio of the height of the folds (H) to (L) is preferably from about 1/16 to about 1, more preferably from about $\frac{1}{8}$ to about $\frac{1}{2}$, and most preferably is about $\frac{1}{4}$.

When the top wall is are pulled taut, the sum of the length and width of the top wall is at least 5 inches greater, and generally no more than 20 inches greater, than the sume of the length and width of the top wall when not pulled taut, and also the sum of the length and width of the bottom wall when pulled taut. Thus, when a user lays on the mattress, he feels as if he is truly floating in water, rather than laying on a taut sleeping surface.

The folds are oriented so that stretching of the mattress occurs more easily from side-to-side than from head-to-foot. Usually a person sleeps on the mattress aligned with the length. Preferably the folds are oriented so that when stretching occurs, the width stretches by a greater percentage than does the length.

This feeling of floating in water can best be effected by filling the mattresses to less than its capacity. The mattress generally has a capacity of at least 12 inches of water. In the use of a mattress according to the present invention, the mattress contains water in an amount at least 3 inches less than its capacity. Thus, for a mattress with 12 inches of water capacity, the mattress contains no more than 8 to 9 inches of water. For a mattress with 14 inches of water capacity, the mattress contains no more than 11 inches of water.

Preferably the mattress contains a cushion for preventing bottoming of the top wall of the mattress when a user sits or lays on the mattress.

It is not necessary that the entire top surface of the mattress have folds. For example, to accommodate a couple where one member of the couple wants a firm surface and the other desires a soft surface, only hal of the mattress has folds.

In addition, the amount of stretch provided by the folds can vary in different regions of the top wall of the mattress by varying the spacing between folds and the size of the folds. For example, if one member of a couple desires a low tension surface while the other member desires a firm surface, one half of the mattress can have a large number of folds spaced close to each other where the folds are generally large, while the other half of the mattress can have no folds, or a relatively same number of folds spaced a greater distance apart from each other, where the folds are of smaller size. Thus the amount of stretch on, the top wall of the mattress can be varied across the width of the mattress.

Similarly the amount of stretch provided by the folds can be varied from the head to the foot of the mattress. For example, more stretch can be provided by the folds in the heavier regions of the human anatomy such as the shoulder and butt regions, while less stretch is provided in the mid-back and leg region, and even less stretch is provided in the head and feet region.

In an alternate version of the invention, folds can be provided in the side walls of the mattress to provide stretching when a user lays on the mattress. Preferably means are provided for biasing the top wall and bottom wall of the mattress together so that the stretching occurs only when the user lays on the mattress.

DRAWINGS

These and other features, aspects, and advantages of the present invention will become better understood with reference to the following description, appended claims, and accompanying drawings where:

DESCRIPTION

Figures 1, 7:
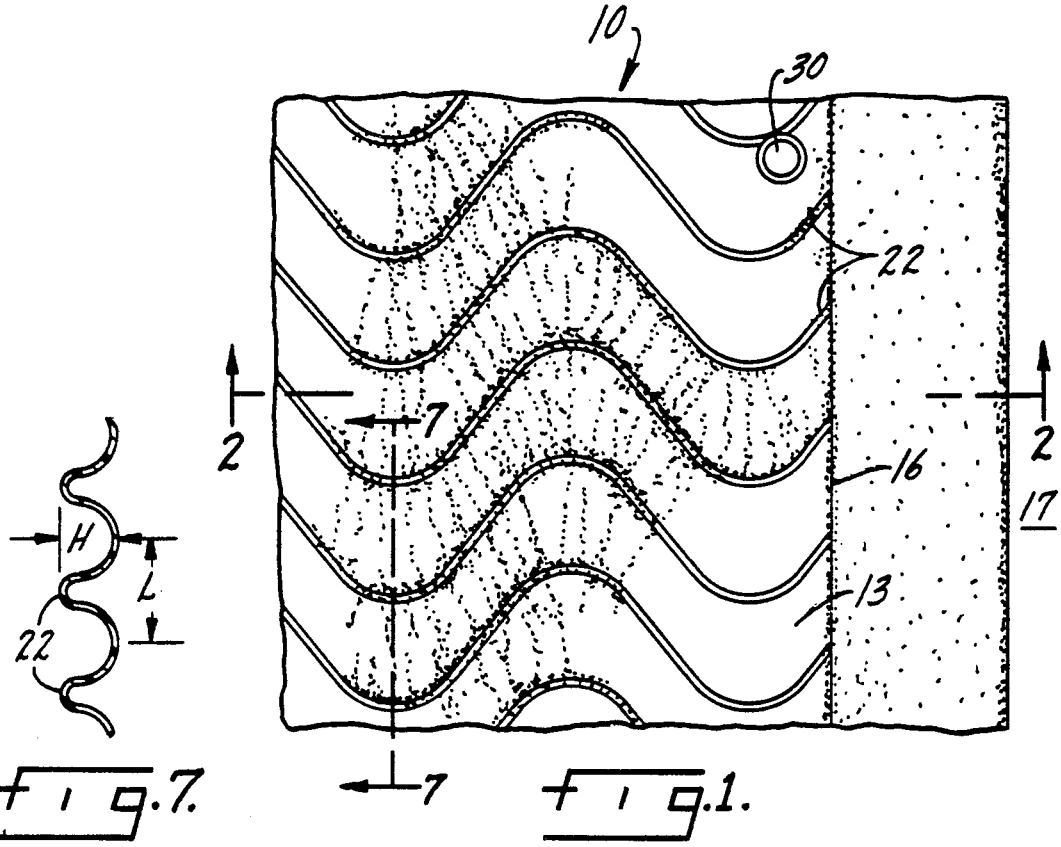
FIG. 1 is a top plan view of a portion of a waterbed having a waterbed mattress according to the present invention, the mattress having regular repeating folds molded into its top surface.
FIG. 7 is another vertical sectional view taken on line 7—7 of FIG. 1 of the mattress of FIG. 1 showing the details of the folds.
Figure 2:
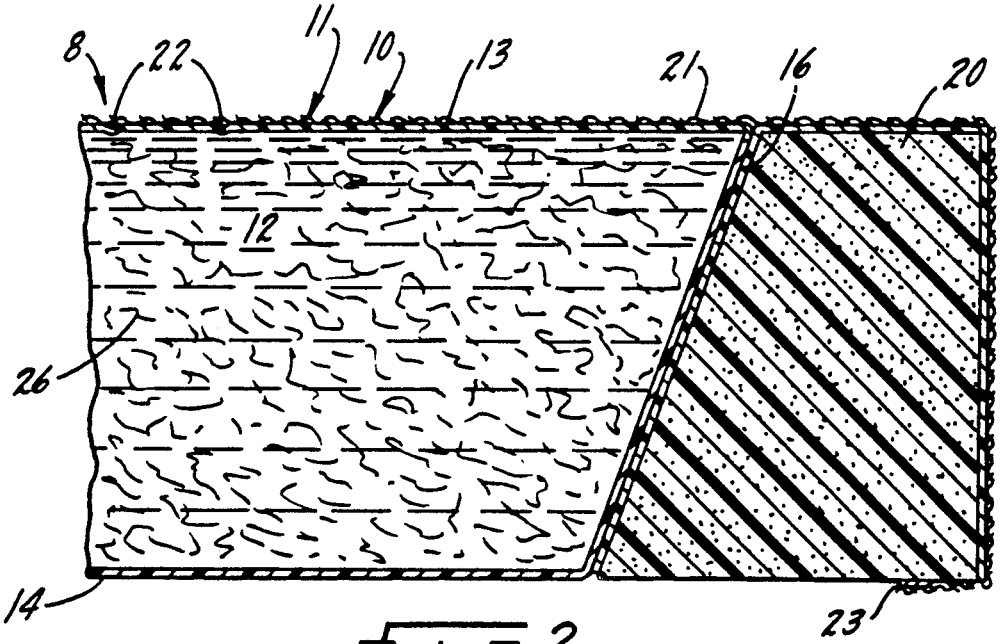
FIG. 2 is a vertical sectional view of a portion of the bed of FIG. 1, without a cover taken on line 2—2 in FIG. 1.

With reference to FIGS. 1 and 2, the present invention is directed to a waterbed 8 having a waterbed mattress 10 that includes an enclosing structure 11 containing a body of water 12. The enclosing structure is fabricated of a flexible polymeric material such as polyvinylchloride or polyethylene. The mattress 10 comprises a top wall 13, a bottom wall 14, and side walls 16. The top wall 13 is adapted for receiving persons in sitting and reclining positions and provides a sleeping surface of the mattress. Water can be introduced into or removed from the mattress through a valve 30 in the top wall 13 near the foot 17 of the bed.

The waterbed 8 can include a frame 20 that encloses the side walls 16 of the mattress 10. The frame 20 shown in the figures is formed of a foam material such as polyurethane foam. Other types of frames can be used such as wood frames, air frames, and plastic frames. Generally, the height of the frame 20 is about equal to the height of the filled mattress 10. The mattress can also be provided with a liner underneath the mattress and between the foam frame 20 and the mattress. For simplicity, the liner is not shown in the figures.

The waterbed 8 can be provided with a cover 21 that extends over the mattress 10 and the frame 20. The cover 21 is tucked under the frame 20 and is held in place by hook and loop type fasteners 23 such as the one sold under the trademark of Velcro.

The top wall 13 of the mattress has a plurality of folds 22 molded therein. By the term "folds" there is meant a part of the top wall that is doubled or laid over another part, including pleats, shirring, puckers, and gathers.

The folds are expandable so that the top wall stretches when a user lays on the mattress. Preferably sufficient expansion is provided that the ratio of the surface area of the top wall 13 when pulled taut to the surface area of the top wall 13 when not pulled taut is at least 1.03, and preferably at least 1.05. By the term "pulled taut" there is meant that the top wall or bottom wall is subjected to a pulling force of 10 pounds. At a ratio of greater than 1.03, a person laying on the mattress feels as if he is actually floating in water, rather than being supported by the top wall of the mattress.

Preferably this ratio is less than about 1.5 because bottoming out can occur, i.e. the top wall can come into contact with the bottom wall. Also, at ratios greater than about 1.5, it is difficult to form folds that are aesthetically pleasing. Further, the user can end up sleeping on wrinkles, which can be uncomfortable. More preferably, the ratio is less than about 1.3, and most preferably less than about 1.2, and optimumly between about 1.05 and 1.1.

Generally the same values apply for ratios of the surface area of the top wall 13 to the surface area of the bottom wall 14 because generally there is no reason to provide excess material in the bottom wall. Thus, preferably sufficient expansion is provided that the ratio of the surface area of the top wall 13 when pulled taut to the surface area of the bottom wall when pulled taut is at least 1.03, and preferably at least 1.05. Likewise, preferably this ratio is less than about 1.5, more preferably less than about 1.3, and most preferably less than about 1.2, and optimumly between about 1.05 and 1.1.

The sum of the length and width of the top wall due to the expandable folds 22 is at least 5 inches greater than the sum of the length and width of the top wall when not pulled taut (also 5 inches greater than the sum of the length and width of the bottom wall when pulled taut. Generally the sum and length of the width of the top wall is no more than 20 inches, and preferably no more than 10 inches greater than the sum of the length and width of the top wall when not pulled taut, and also the sum of the length and width of the bottom wall when pulled taut.

When calculating the sum of the length and width of a wall of a mattress, each dimension is added once. For example, the sum of the width and length of a mattress 96 inches long by 84 inches wide is 180 inches.

The folds or pleats 22 are formed into a pattern that is expandable and aesthetically pleasing. A large number of patterns can be used. For example, as shown in FIG. 1, a curvilinear repeating pattern where each fold 22 has a wave-like configuration can be used.

With reference to FIG. 7, the folds of FIG. 1 are spaced apart from each other by a distance L and each fold has a height H, where H is the vertical distance from the top of one fold to the trough of an adjacent fold, i.e. twice the amplitude of each fold. To achieve the desired stretching, preferably L is from about $\frac{1}{4}$ inch to about 4 inches, more preferably from about 1 to about 3 inches, and most preferably about 2 inches, while the ratio of H to L is preferably from about 1/16 to about 1, more preferably from about $\frac{1}{8}$ to about $\frac{1}{2}$, and most preferably about $\frac{1}{4}$. In the version of FIG. 1, L is 2 inches and H is $\frac{1}{2}$ inch.

Preferably the cover 21 stretches an amount about the same as the mattress 10 stretches. Otherwise, benefits obtained from the stretchable mattress are not realized because the user of the mattress feels as if he is sleeping on a taut cover.

As shown in FIG. 1, preferentially the folds 22 are oriented so that stretching of mattress 10 preferentially occurs side-to-side rather than from head-to-foot. In use of a mattress, generally there is more need for side-to-side stretching, particularly where two people are sleeping on the mattress 10.

Figure 3:
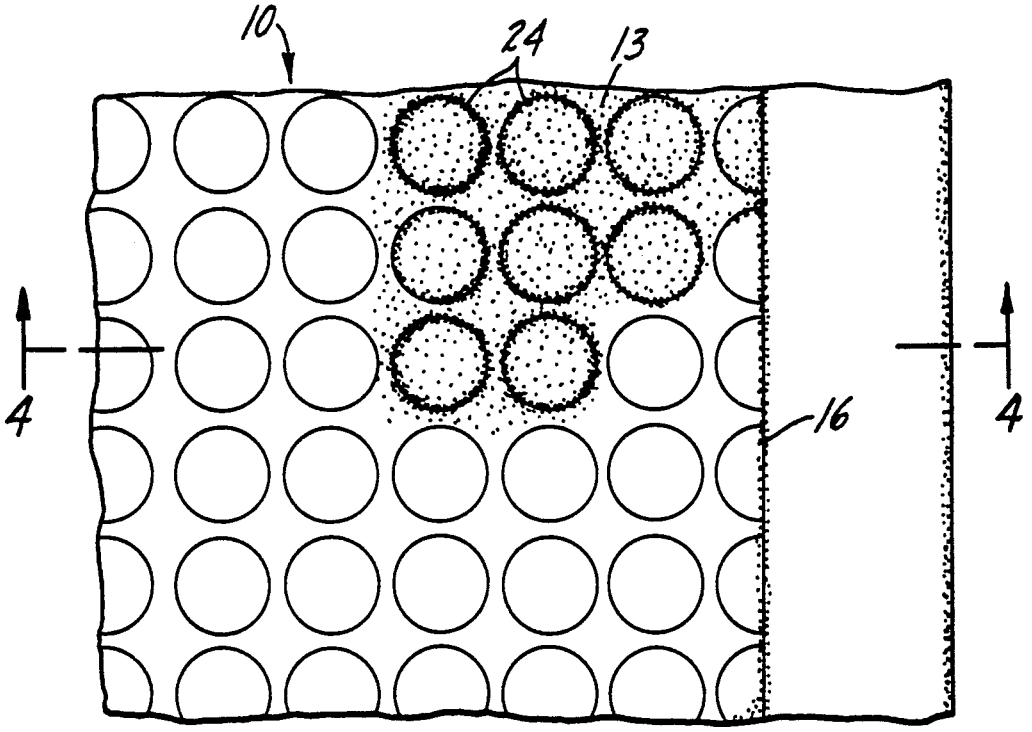
FIG. 3 shows another version of a waterbed having a mattress according to the present invention, the mattress having regular repeating folds molded into its top surface.

In the version of the invention shown in FIG. 3, the folds 24 are in the shape of circular bumps or raised portions. As shown in FIGS. 1 and 3, it is desirable that the fold 22 and 24 be in a regular, uniform repeating pattern so that the expansion of the top wall of the mattress occurs uniformly cross its surface and so that the appearance of the top wall is attractive.

A variety of other shapes can be used, including curled, looped, swirled, curlique, quilted, box, rectangular, and triangular patterns.

Preferably the mattress 10 is provided with an internal structure to avoid bottoming out of the mattress, particularly when the ratio of the surface area of the top wall to the bottom wall is large. A variety of structures conventionally used for baffling can be provided. For example, as shown in FIG. 2, the inside of the mattress can be provided with fiber material 26. The use of fiber in a mattress is described in U.S. Pat. No. 4,301,560 issued to Fraige.

Figure 4:
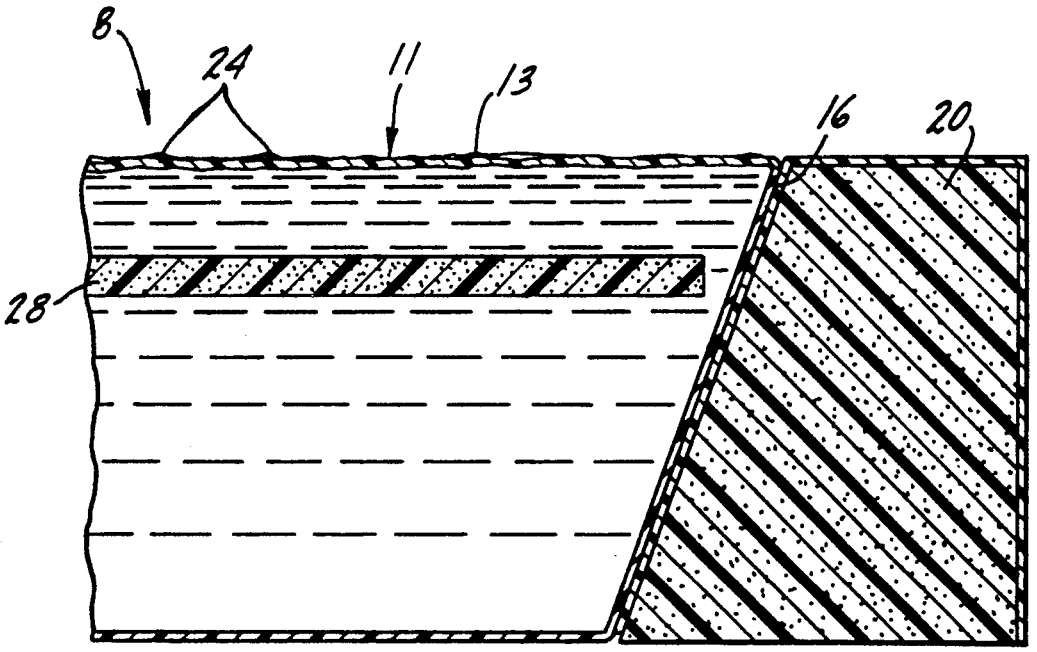
FIG. 4 is a vertical sectional view of a portion of the bed of FIG. 3 taken along line 4—4 in FIG. 3.

In FIG. 4 there is shown a baffle structure comprising a horizontal, floating piece of foam 28 as described in U.S. Pat. No. 4,345,348 issued to Charles P. Hall, which is incorporated herein by this reference.

Preferably the mattress 10 is not filled to capacity. By the term "capacity", there is meant the amount of water in the mattress when the center of the mattress becomes higher than that portion of the mattress 4 inches from the side, i.e. when a crowning effect first occurs. Normally waterbed mattresses have an 8 to 9 inch capacity. That is, when the mattress is filled to capacity, its height is about 8 inches. Likewise, the frames 20 provided for the mattress generally are about 8 to 9 inches in height.

A mattress according to the present invention has a capacity at least about 3 inches greater than the amount of water in the mattress. A mattress designed to fit into a conventional frame has a capacity of at least 11 to 12 inches and when used would contain about 8 to 9 inches of water to obtain a feeling of floating in water. Preferably the capacity of the mattress is about 6 inches greater than the amount of water in the mattress. For example, a mattress filled to thickness of about 8½ to 9½ inches has a capacity of 14 inches or greater. Preferably the capacity is no more than about 9 inches greater than the amount the mattress is to be filled to avoid bottoming out in use.

The enclosing structure 11 can be formed in any suitable manner. Preferably it is formed by bonding two planar sheets together along their peripheries or by bonding two upstanding sheets between the edges of the top and bottom walls to form a contour or fitted structure To obtain the folds in the top wall of the mattress, preferably the top wall is vacuum molded. In vacuum forming the top wall, the vinyl material is heated until it softens, generally to a temperature of about 250° F. Preferably high molecular weight vinyl is used to take the set required to form the folds. Preferably the top wall is formed from thicker vinyl than the remaining portion of the mattress to accommodate the folds. For example, the top wall can be formed from 25 mil thick (0.025 inch) vinyl while the bottom wall is formed from a sheet of 20 mil thick vinyl. The folds can also be formed by extruding the mattress.

Figure 8:
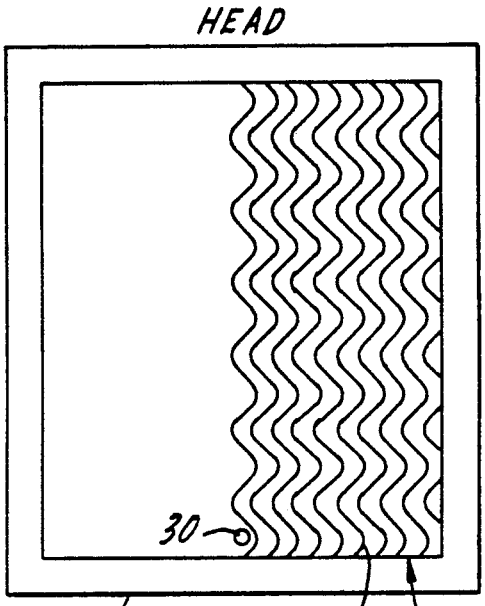
FIGS. 8-11 each show a top plan view of a different version of a waterbed mattress according to the present invention.

In the version of the invention shown in FIG. 8, a mattress 80 with a fill/drain valve 30 is enclosed by a frame 82. Only a portion of the surface of the mattress has folds 84 formed therein, namely the right-side of the mattress. This allows a single mattress to be used for a person who desires a firm mattress (the left side and for a person who desires a soft low tension mattress (right side).

Figure 9:
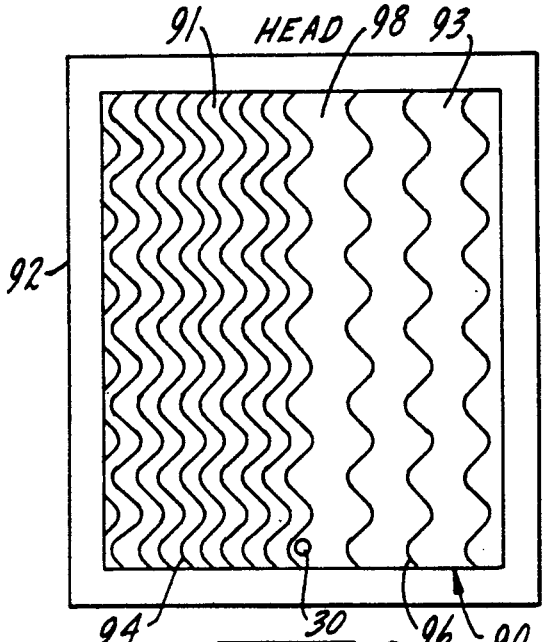

FIG. 9 shows a mattress 90 similar to the mattress of FIG. 8. In FIG. 9, the mattress 90 with a fill/drain valve 30 is enclosed by a frame 92. The top wall of the mattress 90 has a left region 91 of the mattress having a plurality of relatively large closely spaced folds 94 while the right region 93 of the mattress has a plurality of smaller further spaced apart folds 96. Thus, there is more stretch on the left side than on the right side of the mattress 90. Preferably the central region 98 of the mattress as an amount of stretch intermediate the stretch of the left and right sides of the mattresses so that there is not an abrupt change in the amount of stretch. The left side 91 of the mattress with the folds 94 is better adapted for a person who likes a relatively soft, low tension mattress while-the right side 93 is better adapted for a person desiring a stiffer, more firm sleeping surface.

Figure 10:
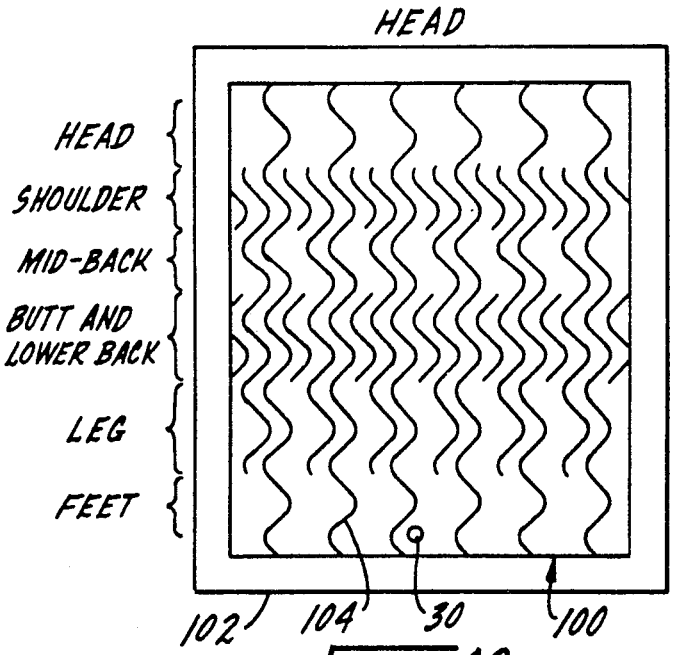

FIG. 10 shows another version of the present invention where a mattress 100 having a fill/drain valve 30 is surrounded by a frame 102. The mattress has a plurality of folds 104 on its top surface. Along the left side of the drawing there are identified different regions of the mattress 100 that correspond to different portions of the body, namely head, shoulder, mid-back, butt and lower back, legs, and feet regions. The amount of stretch built into the top wall of the mattress 100 by is folds 104 is controlled by the number of folds and/or size of the folds in the different regions. For example the most stretch is available in the shoulder region and butt and lower back region, with the least amount of stretch is available in the head region and feet region. Intermediate stretch is available in the mid-back region and leg region.

The size of the regions is chosen to conform to the general human anatomy. For example, for a standard seven foot mattress, the length of the head, shoulder, mid-back, butt and lower back, leg, and feet regions can be 1 foot, 1 foot, 1 foot, 1½ feet, 1½ feet, and 1 foot, respectively.

Figure 11:
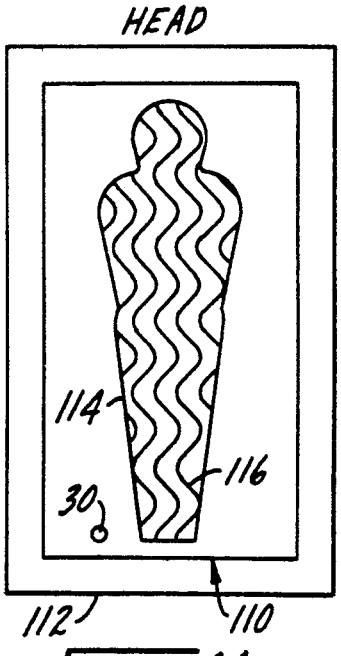

In the version of the invention shown in FIG. 11, a mattress 110 having a fill/drain valve is surrounded by a frame 112. The mattress 110 has formed in its top surface a region 114 of folds 116, where the region 114 of folds conforms to the human anatomy. A mattress can also be provided with two such regions 114 of folds 116 conforming the human anatomy. Thus in this version the region of stretching is limited to that which is actually needed by a particular user. The mattress 110 provides a "cocooning" effect, which can be very pleasurable.

It should be realized that the variations of the invention shown in FIGS. 8–11 can be combined in a single mattress. For example, the head-to-foot variation in stretchability of the mattress shown in FIG. 10 can be superimposed on the side-to-side variations in stretchability of the mattresses shown in FIGS. 8, 9 and 11. That is, a mattress can be formed so that the stretchability of the top surface varies not only from side-to-side, but also from head-to-foot.

Figure 5:
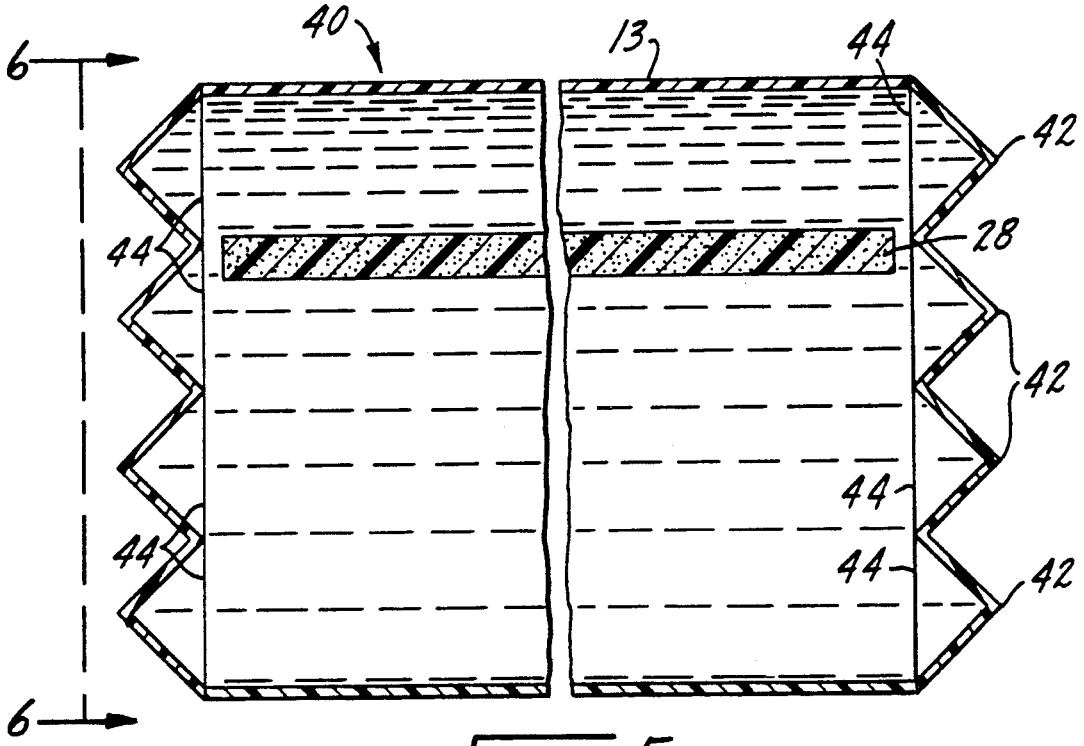
FIG. 5 is a vertical sectional view of another version of a mattress according to the present invention where folds are molded into the side wall of the mattress.
Figure 6:
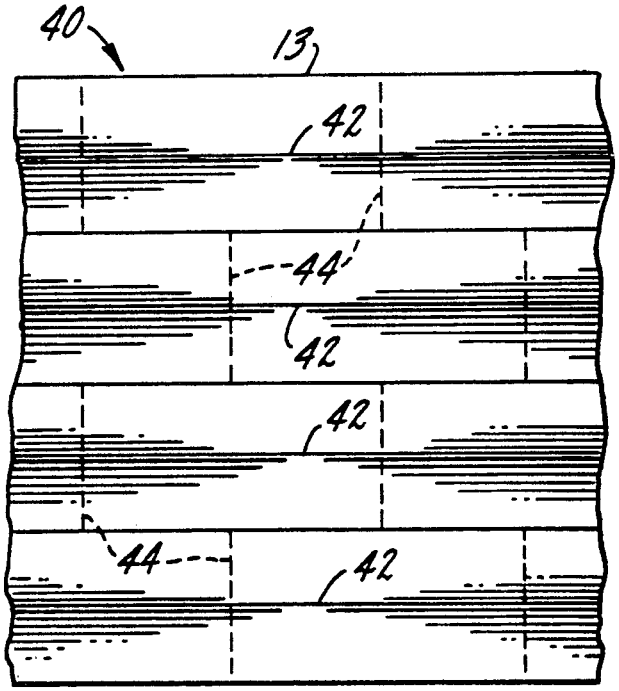
FIG. 6 is a side elevation view of the mattress of FIG. 5 taken on line 6—6 in FIG. 5.

In an alternate version of the present invention rather than providing the folds in the top wall, the folds can be provided in the side walls, as shown in FIGS. 5 and 6. In the mattress 40 shown in FIGS. 5 and 6, there are a plurality of folds 42 in the side walls, giving an accordion-like appearance. To avoid sagging when a user is not on the mattress, internal elastic ties 44 are provided which pull the folds toward each other and pull the top and bottom walls toward each other. The ties 44 can be made of a polymeric synthetic rubber material that can be heat welded or bonded by adhesive to the mattress. A suitable material is Neoprene rubber. There elastic members 44 maintain the mattress in a generally box-like configuration when someone is not laying on the mattress, but allow the folds 42 to expand without excessive resistance when weight is placed on the top wall 13 of the mattress. If desired, external elastic ties can be used in place of or in addition to the internal ties 44.

The mattress of the present invention has significant advantages. Not only is it aesthetically pleasing, it provides a true feeling of "floating" in water. Further, excessive pressure on the person sleeping is avoided. Moreover, when two persons of different weights are sleeping on the mattress, due to the high compliance and stretchability of the pleated top surface, the lighter person is not pulled into a "valley" formed by the heavier person.

Although the present invention has been described is considerable detail with reference to certain preferred versions thereof, other versions are possible. For example, a mattress having folds in both the top wall and the side wall can be provided. Therefore, the spirit and scope of the appended claims should not necessarily be limited to the description of the preferred versions contained herein.

What is claimed is:

1. A waterbed mattress having a polymeric top wall providing a sleeping surface, a bottom wall, and side walls, the ratio of the surface area of the top wall when pulled taut to the surface area of the top wall when not pulled taut being at least 1.05 and less than 1.2, the top wall having a plurality of expandable folds formed therein so that the top wall stretches when a user lays on the mattress, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress and for preventing bottoming of the top wall of the mattress when a user sits or lays on the mattress.

2. The waterbed mattress of claim 1 wherein the sum of the length and width of the top wall when pulled taut is at least 5 inches greater than the sum of the length and width of the top wall when not pulled taut.

3. The mattress of claim 2 in which the sum of the length and width of the top wall when pulled taut is no more than 20 inches greater than the sum of the length and width of the top wall when not pulled taut.

4. The mattress of claim 1 in which the mattress capacity is at least 14 inches of water.

5. The mattress of claim 1 in which all of the folds are in a regular repeating pattern.

6. The mattress of claim 1 in which L is at least about 3 inches.

7. The mattress of claim 1 in which the top wall has a length and a width, the length being greater than the width, and wherein the folds are formed into the mattress so length increases when a user lies on the mattress aligned with the length of the top wall.

8. The mattress of claim 1 including a stretchable cover on the top wall of the mattress.

9. The mattress of claim 8 in which the cover stretches in an amount about the same as the top wall of the mattress stretches.

10. The mattress of claim 1 in which the folds are molded into the top wall.

11. The mattress of claim 1 including a frame around the periphery of the mattress and a cover extending over the mattress and the frame, the cover stretching in an amount about the same as the top wall of the mattress stretches.

12. The mattress of claim 1 in which the folds are curvilinear.

13. The mattress of claim 1 in which the top wall is made of high molecular weight vinyl.

14. The mattress of claim 1 in which the top wall is made of thicker polymeric material than is the bottom wall.

15. The mattress of claim 1 including expandable folds in the side walls.

16. The mattress of claim 1 including a frame around the periphery of the mattress, the height of the frame at least 3 inches less than the mattress capacity.

17. An aesthetically pleasing, low tension waterbed mattress having a polymeric top wall provided a sleeping surface, a bottom wall, and side walls, the top wall having a length and a width, the length being greater than the width, the ratio of the surface area of the top wall when pulled taut to the surface area of the top wall when not pulled taut being at least 1.05 and less than 1.2, the top wall having a plurality of curvilinear expandable folds formed therein so that the top wall stretches when a user lays on the mattress for avoiding excessive pressure on the user, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$ so that the mattress has an aesthetically pleasing appearance, the mattress capacity being at least 11 inches of water, and the mattress containing (i) water in an amount of at least 3 inches less than its capacity and (ii) a baffle for reducing wave motion in the mattress when a user sits or lays on the mattress, wherein the folds are formed into the mattress so that the width of the top wall increases by a greater percentage than the length of the top wall increases when a user lays on the mattress aligned with the length of the top wall.

18. The waterbed mattress of claim 17 wherein the sum of the length and width of the top wall when pulled taut is at least 5 inches greater than the sum of the length and width of the top wall when not pulled taut.

19. The mattress of claim 18 in which the sum of the length and width of the top wall when pulled taut is no more than 20 inches greater than the sum of the length and width of the top wall when not pulled taut.

20. The mattress of claim 17 in which the mattress capacity is at least 14 inches of water.

21. The mattress of claim 17 in which all of the folds are in a regular repeating pattern.

22. The mattress of claim 17 in which L is at least about 3 inches.

23. The mattress of claim 17 including a stretchable cover on the top wall of the mattress.

24. The mattress of claim 23 in which the cover stretches in an amount about the same as the top wall of the mattress stretches.

25. The mattress of claim 17 in which the folds are molded in to the top wall.

26. The mattress of claim 17 including a frame around the periphery of the mattress and a cover extending over the mattress and the frame, the cover stretching in an amount about the same as the top wall of the mattress stretches.

27. The mattress of claim 17 in which the top wall is made of high molecular weight vinyl.

28. The mattress of claim 17 in which the top wall is made of thicker polymeric material than is the bottom wall.

29. The mattress of claim 17 including expandable folds in the side walls.

30. The mattress of claim 17 including a frame around the periphery of the mattress, the height of the frame being at least 3 inches less than the mattress capacity.

31. A waterbed mattress having a polymeric top wall providing a sleeping surface, a bottom wall, and side walls the ratio of the surface area of the top wall when pulled taut to the surface area of the top wall when not pulled taut being at least 1.05 and less than 1.2, the top wall having a plurality of expandable folds formed therein so that the top wall stretches when a user lays on the mattress, at least a portion of the folds being circular, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress and for preventing bottoming of the top wall of the mattress when a user sits or lays on the mattress.

32. A waterbed comprising a frame and within the frame a waterbed mattress having a polymeric top wall providing a sleeping surface, a bottom wall, and side walls, the top wall having a length and a width, the length being greater than the width, the ratio of the surface area of the top wall when pulled taut to the surface area of the top wall when not pulled taut being at least 1.05 and less than 1.2, the top wall having a plurality of expandable folds formed therein so that the top wall stretches when a user lays on the mattress, at least a portion of the folds being in a regular repeating pattern spaced apart from each other by a distance, L, of from about $\frac{1}{4}$ to about 3 inches, the ratio of the height of the regularly repeating folds to L being from about $\frac{1}{8}$ to about $\frac{1}{2}$, the mattress capacity being at least 11 inches of water, and the mattress containing (i) water in an amount of at least 3 inches less than its capacity and (ii) a baffle for reducing wave motion in the mattress when a user sits or lays on the mattress.

33. The bed of claim 32 wherein the folds are formed into the mattress so that the width of the top wall increases by a greater percentage than the length of the top wall increases when a user lays on the mattress aligned with the length of the top wall.

34. The waterbed of claim 32 including a stretchable cover.

35. The waterbed of claim 34 in which the cover stretches in an amount about the same as the top wall of the mattress stretches.

* * * * *